United States Patent [19]

Haynes

[11] Patent Number: 4,693,609

[45] Date of Patent: Sep. 15, 1987

[54] MECHANISM FOR AND METHOD OF AGRICULTURAL CHEMICAL FORMULATION

[75] Inventor: Robert W. Haynes, Grand Forks, N. Dak.

[73] Assignee: Terra International, Inc., Sioux City, Iowa

[21] Appl. No.: 819,363

[22] Filed: Jan. 16, 1986

[51] Int. Cl.[4] ..... B01F 5/10; B01F 7/26

[52] U.S. Cl. ..... 366/136; 366/140; 366/145

[58] Field of Search ..... 366/136, 137, 140, 142, 366/143, 159, 164, 168, 279, 290, 145, 150, 155, 158, 241, 245, 242, 348, 349

[56] References Cited

U.S. PATENT DOCUMENTS

| | | | |
|---|---|---|---|
| 2,107,390 | 2/1938 | Rosmait | 366/136 |
| 2,516,884 | 8/1950 | Kyame | 366/136 |
| 2,633,436 | 3/1953 | Martin | 366/137 |
| 3,254,877 | 6/1966 | Goodwin | 366/137 |
| 4,007,921 | 2/1977 | Zingg | 366/136 |

*Primary Examiner*—Robert W. Jenkins

*Attorney, Agent, or Firm*—Stoll, Wilkie, Previto & Hoffman

[57] ABSTRACT

A mechanism for agricultural chemical formulation including a mixing tank and a dispersion tank. A rotatable shar blade is mounted within the dispersion tank which has a bottom wall and a side wall. The formulation is transferred from the mixing tank into the dispersion tank through an opening in the bottom wall with the shar blade being in close adjacency to the opening in order to permit the shar blade to strike the formulation as soon as it enters the dispersion tank. The formulation is re-circulated back into the mixing tank and the re-circulation between the two tanks is continued until it reaches the correct consistency.

16 Claims, 4 Drawing Figures

MECHANISM FOR AND METHOD OF AGRICULTURAL CHEMICAL FORMULATION

The present invention relates to an agricultural chemical formulating mechanism and more particularly to a chemical formulating mechanism for making flowable agricultural pesticides.

Flowable chemicals, such as agricultural pesticides, are becoming more prevalent in the agricultural market for a number of reasons. Granular pesticides are difficult to handle and may be inhaled by the consumer which makes such pesticides a hazard. In addition, some pesticides are non-dissolvable and therefore flowable pesticides are the only ones which can be used in some situations. Furtheremore, flowables are more accurately measured in the mixing tank than dust or granules and therefore the amount of pesticide in a particular liquid can be very accurately measured.

Such flowable chemicals, such as pesticides, have been prepared in a mixing tank in which the shar mixing assembly is placed directly into the mixing tank to permit the shar to mix the contents in the entire tank. However, this resuts in uneven mixing so that the same consistent results are not always achieved.

The present invention is an improvement over existing chemical formulating mechanisms and provides an improved chemical formulating mechanism in which the shar can process large batches of chemical with consistent results.

Another object of the present invention is the provision of an improved chemical formulating mechanism in which the shar can evenly process all the contents of the mixing tank.

Another object of the present invention is the provision of an improved chemical formulating mechanism which permits the shar to process the contents in a continuous flow.

Another object of the present invention is the provision of an improved chemical formulating mechanism in which samples of the product can be obtained from the top of the mixing tank in order to determine when the product has reached the desired consistency.

Another object of the present invention is the provision of an improved chemical formulating mechanism in which the shar is so positioned in a dispersion tank so that it can act on the product immediately upon the product being introduced into the dispersion tank.

Another object of the present invention is the provision of an improved chemical formulating mechanism in the shar which processes the product, which is located in a separate, self-contained dispersion tank.

Another object of the present invention is the provision of an improved chemical formulating mechanism which can be housed in a mobile unit in order to permit it to be moved from one location to another.

Other and further objects of the invention will be obvious upon an understanding of the illustrative embodiment about to be described, or will be indicated in the appended claims, and various advantages not referred to herein will occur to one skilled in the art upon employment of the invention in practice.

A preferred embodiment of the invention has been chosen for purposes of illustration and description and is shown in the accomoanving drawings forming a part of the specification.

Figure 1:
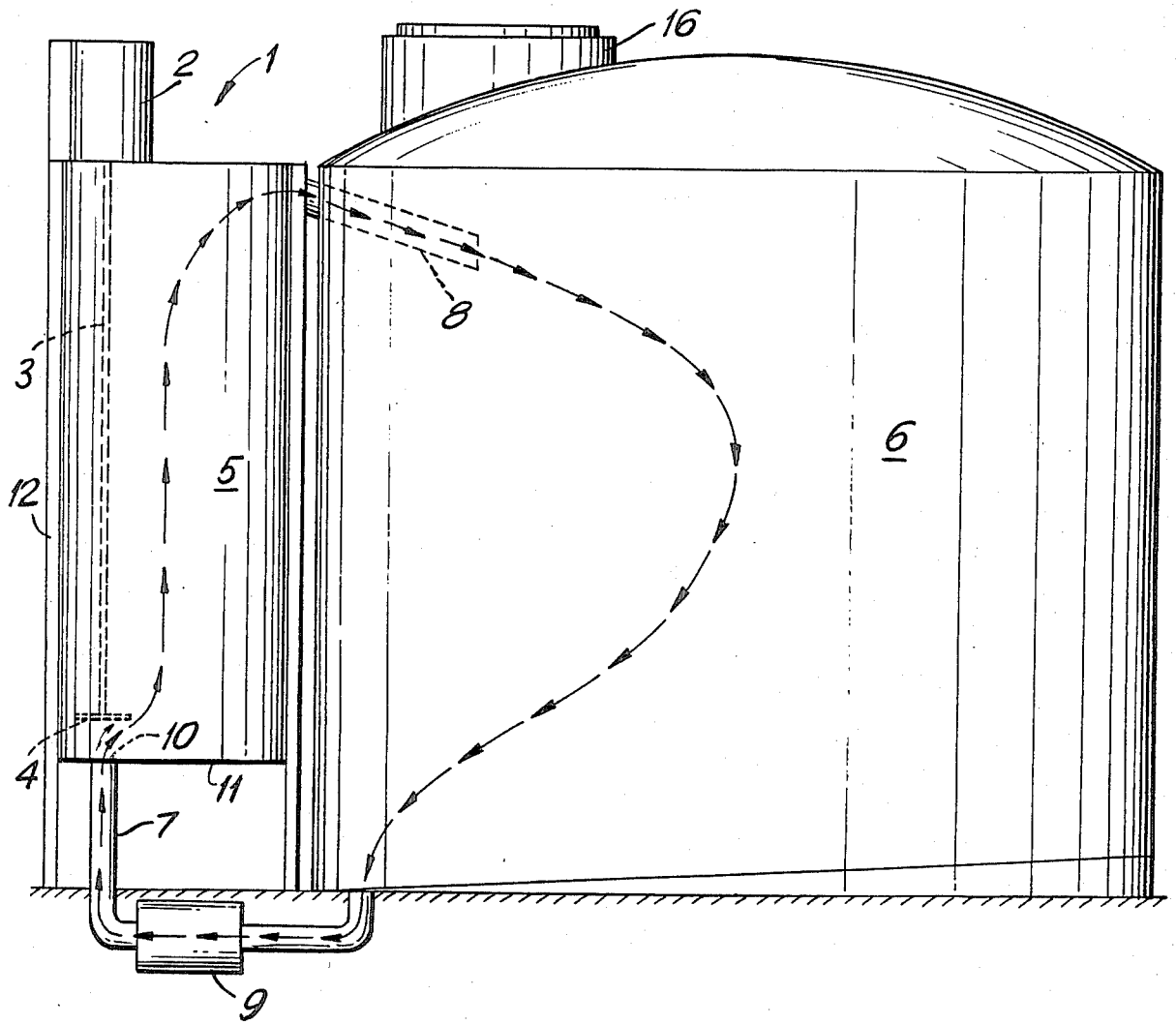
FIG. 1 is a schematic drawing of the improved chemical formulating mechanism of the present invention.

Referring to the drawings and, more particularly, to FIG. 1, the shar assembly 1 comprises a motor 2 which has a stainless steel shaft 3 extending therefrom which terminates in a rotatable blade 4. The shar assembly 1 is mounted in a separate shar dispersion tank 5 adjacent a mixing tank 6. The dispersion tank and the mixing tank are connected together by a lower inlet pipe 7 and an upper outlet pipe 8. The inlet pipe 7 is provided with a pump 9 in order to transfer liquid from the mixing tank 6 and into the shar dispersion tank 5 from the bottom. It will be seen that the direction of flow of the flowable material is from the mixing tank 6 through the pipe 7 into the dispersion tank 5 where it is acted on by the shar blade 4 and then the liquid is circulated back to the mixing tank 6 through the upper outlet 8. This circulation is continued until the flowables reach the proper consistency. A mixing unit 22 promotes circulation.

The liquid enters the dispersion tank 5 tnrough the opening 10 in tne bottom wall of the dispersion tank 5. The shar blade 4 is about 5" directly above the opening 10 so that the shar blade strikes and operates on the product as soon as it enters the dispersion tank 5. Also, preferably, the position of the outer edge of the blade is approximately 2½" from a side wall 12 of the dispersion tank 5. The position of the shar blade 4 with respect to outlet 10 and the side wall 12 insures that the product which is being processed will immediately be stirred by the shar blade 4 as soon as it enters the dispersion tank 5, so that every portion of the flowable material will be processed.

The product which may be made by the present invention consists of any flowable pesticide, such as a fungicide, and which may consist of flowable maneb, copper, etc. The product, for example, copper, is added to the mixing tank 6 by an auger 15 which is shown more clearly in FIG. 2. The mixing tank 6 may also contain a surfactant as well as a defoamer and a sticking agent, depending upon the type of product that is desired. The dispersion tank 5 may contain a thickening agent, such as xanthane gum, if such a thickening agent is desired. As explained above, the products in the mixing tank 6 are directed by the pump 9 into the dispersion tank 5 by a pipe 7. As soon as the materials are introduced into the dispersion tank 5 through the opening 10 therein, they are struck by the shar blade 4 which is rotating very rapidly. The blade 4 grinds and breaks down the components of the product into smaller components.

The product is then circulated upwardly and reintroduced into a mixing tank 6 through the outlet 8. At this point, the larger micron particles of the product fall to the bottom of the mixing tank 6 before the smaller micron particles. Thus, the larger particles are pumped back into the dispersion tank 5 to be further ground into smaller units by the shar blade 4. The stirring by the shar blade 4 increases the centipoids of the product. As this process continues, the product is continuously being ground into smaller units until the product reaches the proper consistency. At the top of the mixing tank 6 there is an opening 16 which permits the product in the mixing tank to be sampled so that the user can determine when the product has reached the correct consistency desired. After the product reaches the correct consistency, water can be added to the mixing tank in amounts sufficient to achieve the desired results.

As further indicated above, the closeness of the shar blade 4 to the bottom opening 10 in the dispersion tank 5, as well as the closeness of the outer edge of the shar blade 4 to the side walls 12 of the dispersion tank 5 insures that all the product coming from the mixing tank 6 must strike the blade 4 as soon as it enters the dispersion tank 5. This insures that the entire product will be stirred by the shar blade 4.

Figure 2:
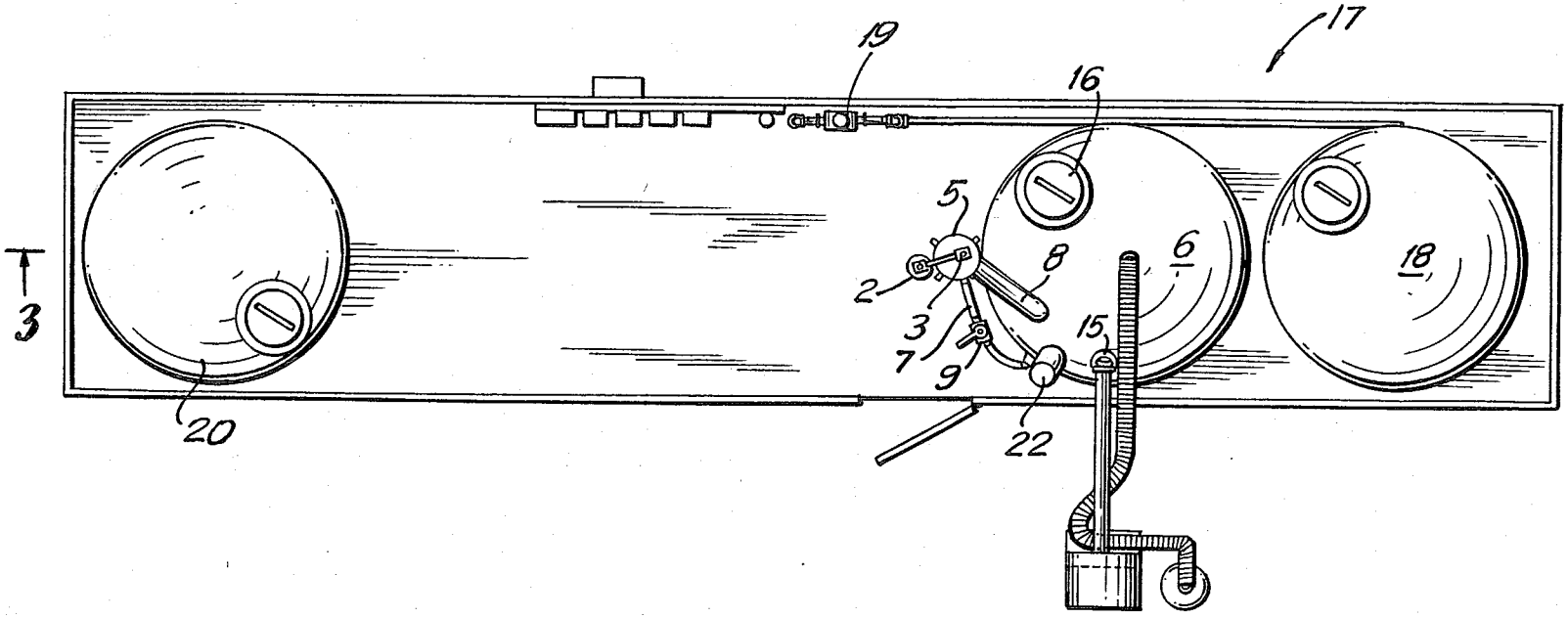
FIG. 2 is a plan view of the improved chemical formulating mechanism as it may be used in a self-contained unit.
Figure 3:
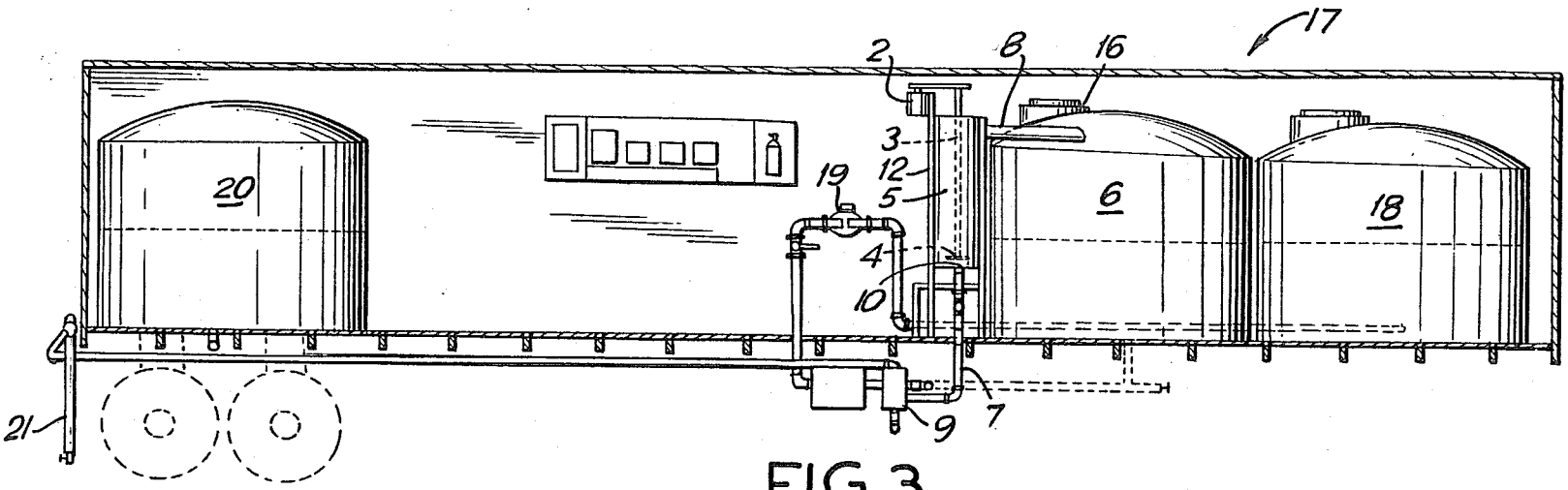
FIG. 3 is a sectional view taken along line 3—3 of FIG. 2.
Figure 4:
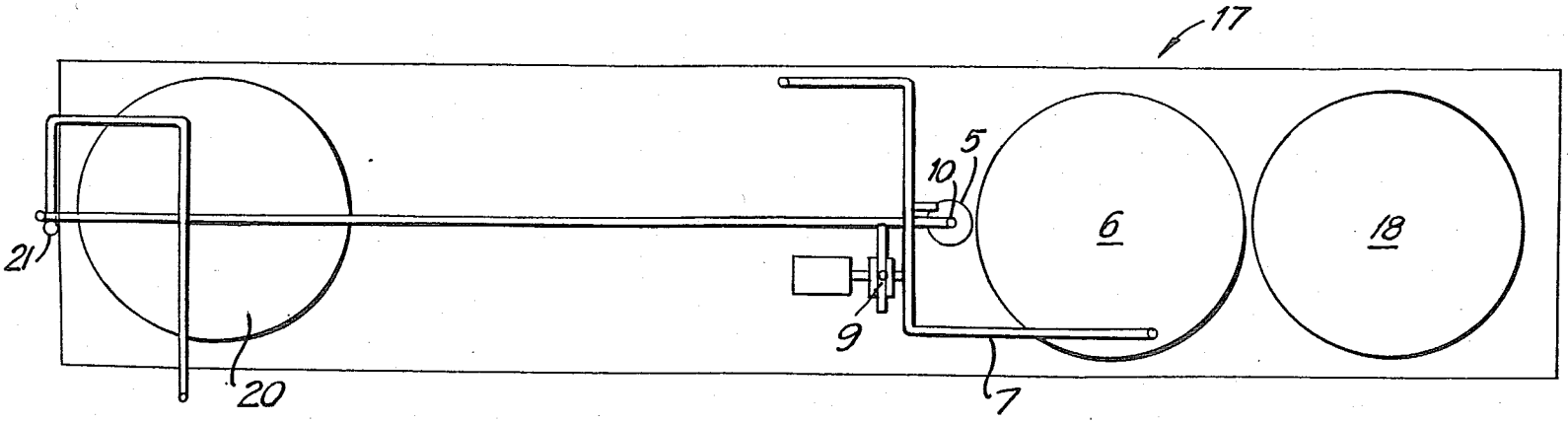
FIG. 4 is a schematic view of the plumbing arrangement which may be used.

FIGS. 2, 3 and 4 show the manner in which the invention may be housed in a self-contained unit 17, which may be a mobile unit, if desired. Within this unit 17, there is provided a water-holding tank 18 which is connected to the mixing tank 6. Preferably, the unit 17 is pollution free, which is accomplished by vacuum units and the unit is air-conditioned to prevent any adverse reaction on the product by high temperatures. There are provided controls, such as the meter 19 so that the operator can supply the exact amounts of liquid needed for the particular product being made. When the product is finished, it is pumped to a finished product tank 20. From the finished product tank 20, it is passed through a stainless steel filter 21 before it is used so that each portion is insured of being filtered before use.

It will thus be seen that the present invention provides an improved chemical formulating mechanism in which the shar evenly processes large batches of chemicals with consistent results and which processes all the contents of the mixing tank in a continuous flow. In addition, the shar is so positioned in a self-contained dispersion tank so that it can act on the product immediately upon the product being introduced into the dispersion tank.

As many and varied modifications of the subject matter of this invention will become apparent to those skilled in the art from the detailed description given hereinabove, it will be understood that the present invention is limited only as provided in the claims appended hereto.

The embodiments of the invention in which an exclusive property of privilege is claimed are defined as follows:

1. A mechanism for agricultural chemical formulation comprising a mixing tank, a dispersion tank, a rotatable shar blade mounted within said dispersion tank, said dispersion tank having a bottom wall and a side wall, means for transferring said formulation from the mixing tank into said dispersion tank through an opening therein, said shar blade being in close adjacency to said opening in the dispersion tank in order to permit the shar blade to strike the formulation as soon as it enters the dispersion tank, and means for returning the formulation back into said mixing tank.

2. A mechanism as claimed in claim 1 wherein means are provided to recirculate said formulation between the said two tanks until it reaches the correct consistency.

3. A mechanism as claimed in claim 2 wherein said opening is in the bottom wall of the dispersion tank and wherein the return means is located adjacent the top of the dispersion tank.

4. A mechanism as claimed in claim 3 wherein said shar blade is positioned over said opening.

5. A mechanism as claimed in claim 4 wherein said shar blade is positioned in close adjacency to a side wall of the dispersion tank.

6. A mechanism as claimed in claim 5 wherein the mixing tank has an opening adjacent the top to permit sampling of the formulation.

7. A mechanism as claimed in claim 6 wherein means are provided to add water to the mixing tank after the formulation reaches the correct consistency.

8. A mechanism as claimed in claim 7 wherein the formulation is removed from the mixing tank from the bottom thereof.

9. A mechanism as claimed in claim 8 wherein the shar blade is located approximately 5" above the opening in the bottom of the dispersion tank.

10. A mechanism as claimed in claim 9 wherein said shar blade is positioned approximately 2½" from the side wall of the dispersion tank.

11. A mechanism as claimed in claim 10 wherein a self-contained housing is provided for said mixing tank and also contains a water tank and a finished product tank and which has a metering means therein, as well as means to maintain a constant temperature and has means for maintaining the atmosphere therewithin pollution free.

12. The method of agricultural chemical formulation in a mechanism having a mixig tank, a dispersion tank having a bottom wall and a sid wall, a rotatable shar blade mounted within said dispersion tank, which comprises transferring said formulation from the mixing tank into said dispersion tank, directing the formulation into close adjacency to the shar blade, in order to permit the shar blade to strike the formulation as soon as it enters the dispersion tank, and returning the formulation back into said mixing tank.

13. A method as claimed in claim 12 wherein said formulation is recirculated between the said two tanks until it reaches the correct consistency.

14. A method as claimed in claim 13 wherein the formulation is sampled from the top of the mixing tank.

15. A method as claimed in claim 14 wherein water is added to the mixing tank after the formulation reaches the correct consistency.

16. A method as claimed in claim 15 wherein the formulation is removed from the mixing tank from the bottom thereof.

* * * * *